US007931010B2

(12) United States Patent
Kato et al.

(10) Patent No.: US 7,931,010 B2
(45) Date of Patent: Apr. 26, 2011

(54) FUEL SUPPLY SYSTEM FOR BOAT AND OUTBOARD MOTOR

(75) Inventors: Masahiko Kato, Shizuoka (JP); Yoshiyuki Kadobayashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 71 days.

(21) Appl. No.: 12/473,294

(22) Filed: May 28, 2009

(65) Prior Publication Data

US 2009/0293843 A1 Dec. 3, 2009

(30) Foreign Application Priority Data

May 30, 2008 (JP) ..... 2008-142622

(51) Int. Cl.
*F02M 37/04* (2006.01)
*F02M 37/20* (2006.01)

(52) U.S. Cl. ..... 123/509; 123/516

(58) Field of Classification Search ..... 123/509, 123/510, 511, 514, 516
See application file for complete search history.

(56) References Cited

U.S. PATENT DOCUMENTS 4,794,889 A * 1/1989 Hensel ..... 123/73 SC
4,809,666 A * 3/1989 Baltz ..... 123/516
4,848,283 A * 7/1989 Garms et al. ..... 123/73 AD
4,876,993 A * 10/1989 Slattery ..... 123/73 AD
4,887,559 A * 12/1989 Hensel et al. ..... 123/73 AD
5,103,793 A * 4/1992 Riese et al. ..... 123/516
5,309,885 A * 5/1994 Rawlings et al. ..... 123/509
5,555,858 A * 9/1996 Katoh ..... 123/73 SC
5,579,740 A * 12/1996 Cotton et al. ..... 123/516
5,647,331 A * 7/1997 Swanson ..... 123/516
6,095,774 A * 8/2000 Tanaka et al. ..... 417/540
2001/0001955 A1 5/2001 Kanno

FOREIGN PATENT DOCUMENTS

JP 2001-152896 A 6/2001

OTHER PUBLICATIONS

Kato et al.; "Fuel Supply System for Boat and Outboard Motor"; U.S. Appl. No. 12/473,290, filed May 28, 2009.
Kato et al.; "Fuel Supply System for Boat and Outboard Motor"; U.S. Appl. No. 12/473,291, filed May 28, 2009.
Kato et al.; "Fuel Supply System for Boat and Outboard Motor"; U.S. Appl. No. 12/473,293, filed May 28, 2009.

* cited by examiner

*Primary Examiner* — Thomas N Moulis
(74) *Attorney, Agent, or Firm* — Keating & Bennett, LLP

(57) ABSTRACT

A fuel supply system for a boat prevents deterioration in engine startability and includes a vapor separator tank arranged to contain fuel at an inner fuel level "P" at a predetermined height, an injector arranged to supply fuel to an engine, and a high-pressure fuel pump that is disposed outside the vapor separator tank and that is arranged to supply the fuel reserved in the vapor separator tank to the injector. The high-pressure fuel pump includes a negative pressure generating portion arranged to generate negative pressure when the high-pressure fuel pump draws fuel, the negative pressure generating portion being positioned lower than the fuel level "P" in the vapor separator tank.

20 Claims, 16 Drawing Sheets

FUEL SUPPLY SYSTEM FOR BOAT AND OUTBOARD MOTOR

BACKGROUND OF THE INVENTION

1. Field of the Invention

The present invention relates to a fuel supply system for a boat and an outboard motor. Specifically, the present invention relates to a fuel supply system for a boat having a fuel supply pump and an outboard motor. The fuel supply pump supplies the fuel reserved in a second fuel tank connected to a first fuel tank mounted on a hull to a fuel injection device.

2. Description of the Related Art

Conventionally, a fuel supply system for a boat having a fuel supply pump that supplies the fuel reserved in a second fuel tank connected to a first fuel tank mounted on a hull to a fuel injection device is known (see JP-A-2001-152896, for example).

The fuel supply system for a boat described in JP-A-2001-152896 is a fuel supply system for a boat employed for an outboard motor. In JP-A-2001-152896, fuel pumped from a fuel tank (first fuel tank) mounted on a hull is reserved in a vapor separator tank (second fuel tank). The fuel reserved in the vapor separator tank is supplied to a fuel injection device by a fuel supply pump. Also, in JP-A-2001-152896, there is provided a so-called in-tank fuel supply pump that is disposed in the vapor separator tank.

In general, a fuel supply pump generates negative pressure to draw fuel therein. However, when negative pressure is generated in order to draw fuel, the fuel may boil under reduced pressure due to the negative pressure. In this case, the fuel becomes vapor, generating bubbles in the fuel supply pump. If bubbles occur in the fuel supply pump, normal fuel transportation will be hampered. Thus, if vapor exists in the fuel supply pump during engine starting, it is difficult to properly transport fuel to a fuel injection device due to the vapor in the fuel supply pump. Therefore, it is necessary to discharge vapor from the fuel supply pump. Accordingly, it takes time to discharge the vapor from the fuel supply pump during engine starting, resulting in deterioration in engine startability.

SUMMARY OF THE INVENTION

In view of the above, preferred embodiments of the present invention provide a fuel supply system for a boat and an outboard motor that minimize and prevent deterioration in engine startability.

A fuel supply system for a boat according to a first preferred embodiment of the present invention includes: a second fuel tank that is connected to a first fuel tank mounted on a hull and arranged to reserve fuel to keep an inner fuel level at a predetermined height; a fuel injection device arranged to supply fuel to an engine; and a fuel supply pump that is disposed outside the second fuel tank and that is arranged to supply the fuel reserved in the second fuel tank to the fuel injection device. The fuel supply pump includes a negative pressure generating portion therein arranged to generate negative pressure when the fuel supply pump draws fuel, the negative pressure generating portion being positioned generally at a same level as or lower than the fuel level in the second fuel tank.

In the fuel supply system for a boat according to the first preferred embodiment, as described above, the fuel supply pump is preferably configured such that the negative pressure generating portion arranged to generate negative pressure when the fuel supply pump draws fuel is positioned generally at a same level as or lower than the fuel level in the second fuel tank. Accordingly, fuel can be drawn into the fuel supply pump with a small negative pressure. That is, when the negative pressure generating portion is positioned higher than the fuel level in the second fuel tank, a large negative pressure is required to draw fuel from the second fuel tank into the fuel supply pump because the fuel needs to be lifted up to a position higher than the fuel level in the second fuel tank. In contrast, when the negative pressure generating portion is positioned generally at a same level as or lower than the fuel level in the second fuel tank, fuel can be drawn into the fuel supply pump with a small negative pressure because no force is required to move the fuel to the negative pressure generating portion. Thus, negative pressure applied to the fuel can be minimized, thereby preventing the fuel in the fuel supply pump from vaporizing due to boiling under reduced pressure caused by an increase of the negative pressure while drawing the fuel. As a result, deterioration in engine startability can be prevented.

The fuel supply system for a boat according to the first preferred embodiment further includes a pipe arranged to connect the fuel supply pump and the second fuel tank, and the negative pressure generating portion of the fuel supply pump is positioned generally at a same level as or lower than a suction opening of the pipe inserted into the second fuel tank.

In the fuel supply system for a boat according to the first preferred embodiment, preferably, the fuel supply pump includes: a fuel path; a first check valve that is provided in the fuel path and that allows the fuel to move from the second fuel tank to the fuel injection device to pass therethrough; a second check valve that is provided closer to the fuel injection device relative to the first check valve in the fuel path and that allows the fuel to move from the second fuel tank to the fuel injection device to pass therethrough; a reserve section that is provided between the first check valve and the second check valve and that reserves fuel; and a negative pressure generating mechanism that causes the negative pressure generating portion to generate negative pressure when the fuel supply pump draws fuel into the reserving section, and the negative pressure generating portion includes a vicinity of the first check valve. With this configuration, the negative pressure generating mechanism causes the negative pressure generating portion to generate negative pressure to draw fuel into the reserve section via the first check valve. In this regard, since the negative pressure generating portion in the vicinity of the first check valve is positioned generally at a same level as to or lower than the fuel level in the second fuel tank, no force (large negative pressure) is required to move fuel to the negative pressure generating portion. Therefore, fuel can be drawn into the fuel supply pump with a small negative pressure. This prevents the fuel in the fuel supply pump from vaporizing due to boiling under reduced pressure caused by an increase of the negative pressure while drawing the fuel.

In the fuel supply system for a boat according to the first preferred, the fuel supply pump is preferably disposed on the side of and adjacent to the second fuel tank. With this configuration, the pipe arranged to connect the second fuel tank and the fuel supply pump can be shortened, thereby decreasing a heat receiving area that receives radiated heat from the engine. This prevents an increase in the fuel temperature in the pipe arranged to connect the second fuel tank and the fuel supply pump, and thereby prevents generation of vapor in the fuel supply pump caused by an increase in the fuel temperature which is a factor of the generation of vapor.

In this case, the fuel supply pump is preferably fixed to the second fuel pump while being spaced apart from the engine.

With this configuration, since the fuel supply pump is not directly supported by the heated engine, a temperature rise of the fuel supply pump caused by heat directly transmitted from the engine can be prevented, differing from the case where the fuel supply pump is supported by the engine via supporting members. This also prevents generation of vapor in the fuel supply pump.

In the configuration in which the fuel supply pump is fixed to the second fuel tank, the second fuel tank and the fuel supply pump are preferably disposed adjacent to a throttle body including a throttle valve arranged to adjust a flow rate of air suctioned by the engine. With this configuration, the second fuel tank and the fuel supply pump that receive radiated heat from the engine are cooled by the throttle body in relatively low temperature. More specifically, since air flows fastest in the throttle body, heat is rapidly absorbed by the air flowing fast or by vaporization of the injected fuel. As a result, the throttle body becomes resistant to temperature increases. The second fuel tank and the fuel supply pump that receive radiated heat from the engine can be cooled by arranging the throttle body in relatively low temperature adjacent to the second fuel tank and the fuel supply pump. Thus, temperature increase in the second fuel tank and the fuel supply pump can be prevented, thereby preventing generation of vapor (vaporized fuel) in the second fuel tank and the fuel supply pump.

In this case, the fuel injection device is preferably configured to be positioned adjacent to the throttle body and inject fuel in the throttle body. With this configuration, all of the fuel supply pump, the second fuel tank, and the fuel injection device can be disposed adjacent to the vicinity of the throttle body. This allows the fuel system to be arranged within a small space, thereby shortening pipes that connect the second fuel tank, the fuel supply pump, and the fuel injection device with each other. This decreases a heat-receiving area that receives radiated heat from the engine, thereby suppressing generation of vaporized fuel. Also, since the fuel system is disposed within a small space, the fuel supply system for a boat can be made compact.

In the fuel supply system for a boat according to the first preferred embodiment, preferably, the fuel supply pump further includes a pressure adjusting device arranged to release fuel when the pressure of the fuel supplied to the fuel injection device is equal to or larger than a predetermined value. With this configuration, the pressure adjusting device installed in the fuel supply pump can release fuel in such a case that the injection device is plugged. This prevents the fuel injection device and the fuel supply pump from being damaged by the excessive fuel pressure.

In this case, preferably, the second fuel tank includes a vapor separator tank arranged to separate a vaporized fuel from a liquid fuel, and the pressure adjusting device is configured to return fuel to the vapor separator tank when the pressure applied to the fuel supplied to the injection device is equal to or larger than the predetermined value. With this configuration, even when the fuel temperature increases to generate vapor in the fuel supply pump, it is possible to return the vapor to the second fuel tank and separate the vapor from the liquid fuel. This prevents vaporized fuel from collecting in the fuel supply pump, and thus it is possible to prevent fuel supply failure to the fuel injection device that is caused by the collected vapor in the fuel supply pump.

In the fuel supply system for a boat according to the first preferred embodiment, the fuel supply pump preferably includes a pump main portion having the fuel path and a pump driving section separated from the fuel path of the pump main portion. With this configuration, even when the pump driving section generates heat, an increase in the fuel temperature due to the generated heat in the pump driving section can be prevented. Accordingly, generation of vapor (vaporized fuel) in the fuel supply pump can be prevented.

In this case, the pump driving section is preferably configured to drive the pump main portion with a driving force of the engine. With this configuration, an extra driving source such as a motor is not required to drive the pump main portion as the pump driving section.

In the configuration in which the pump main portion through which fuel passes is driven by the pump driving section through which fuel does not pass, the pump driving section is preferably configured to drive the pump main portion with a driving force of a motor separated from the fuel path of the pump main portion. With this configuration, an increase in the fuel temperature caused by the heated motor can be prevented even when the motor is utilized to drive the pump main portion. Accordingly, generation of vapor (vaporized fuel) in the fuel supply pump can be prevented.

An outboard motor according to a second preferred embodiment of the present invention includes: an engine; a second fuel tank that is connected to a first fuel tank mounted on a hull and arranged to reserve fuel to keep an inner fuel level at a predetermined height; a fuel injection device arranged to supply fuel to the engine; and a fuel supply pump that is disposed outside the second fuel tank and that is arranged to supply the fuel reserved in the second fuel tank to the fuel injection device. The fuel supply pump preferably includes a negative pressure generating portion that generates negative pressure when the fuel supply pump draws fuel, the negative pressure generating portion being positioned generally at a same level as or lower than the fuel level in the second fuel tank.

In the outboard motor according to the second preferred embodiment, as described above, the fuel supply pump is preferably configured such that the negative pressure generating portion arranged to generate negative pressure when the fuel supply pump draws fuel is positioned generally at a same level as or lower than the fuel level in the second fuel tank. Accordingly, fuel can be drawn into the fuel supply pump with a small negative pressure. That is, when the negative pressure generating portion is positioned higher than the fuel level in the second fuel tank, a large negative pressure is required to draw fuel from the second fuel tank into the fuel supply pump because the fuel needs to be lifted up to a position higher than the fuel level in the second fuel tank. In contrast, when the negative pressure generating portion is positioned generally at a same level as or lower than the fuel level in the second fuel tank, fuel can be drawn into the fuel supply pump with a small negative pressure because no force is required to move the fuel to the negative pressure generating portion. Thus, negative pressure applied to the fuel can be minimized, thereby preventing the fuel in the fuel supply pump from becoming vapor due to boiling under reduced pressure caused by an increase of the negative pressure while drawing the fuel. As a result, deterioration in engine startability can be prevented.

Other features, elements, steps, characteristics and advantages of the present invention will become more apparent from the following detailed description of preferred embodiments of the present invention with reference to the attached drawings.

DETAILED DESCRIPTION OF THE PREFERRED EMBODIMENTS

Now, preferred embodiments of the present invention will be described in the following sections based on the drawings.

Figure 1:
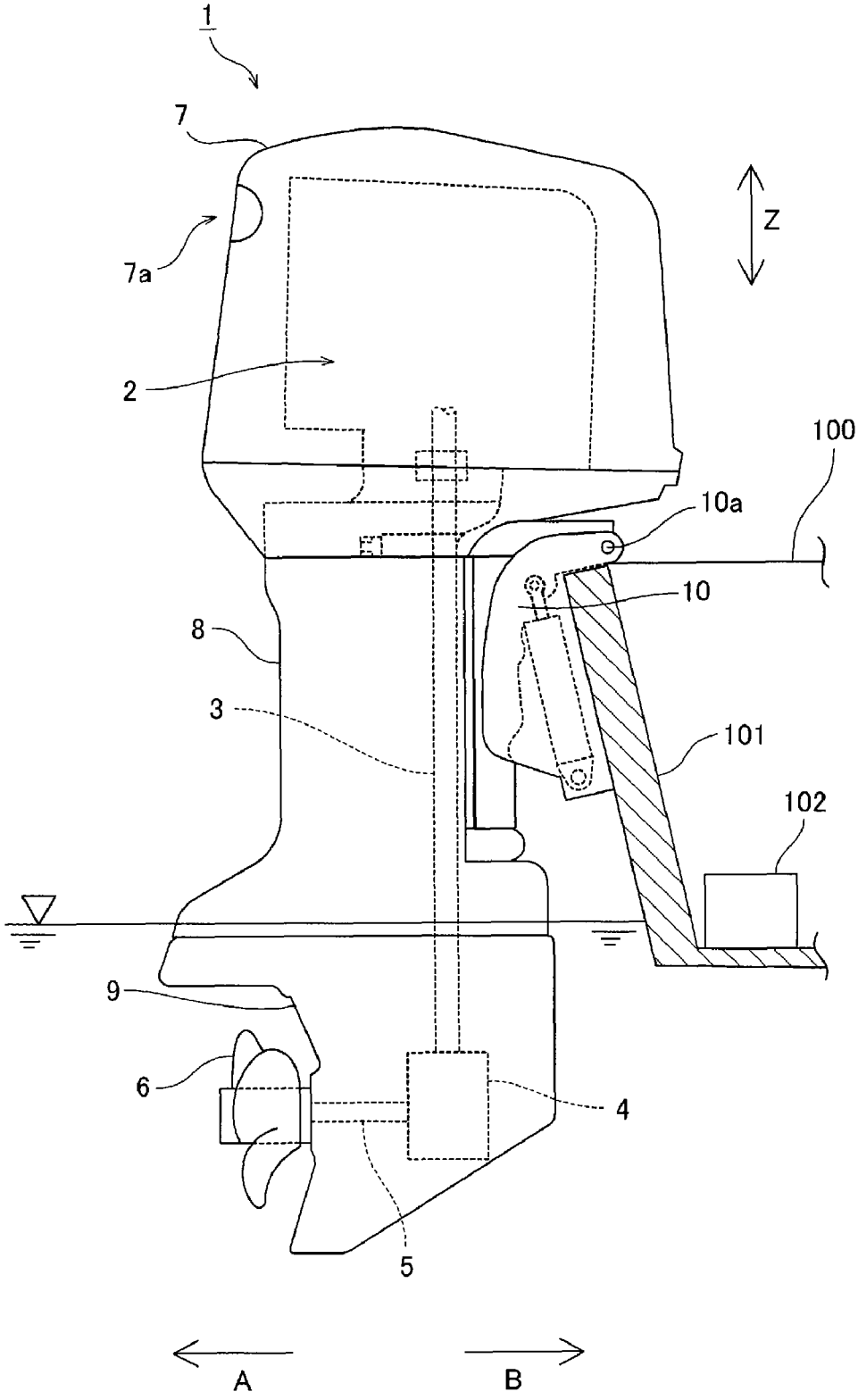
FIG. 1 is a side view showing a general construction of an outboard motor according to a preferred embodiment of the present invention.

FIG. 1 is a side view showing an overall configuration of an outboard motor that includes a fuel supply system for a boat according to a preferred embodiment of the present invention. FIGS. 2 to 12 are illustrations showing the detailed structure of an engine of the outboard motor shown in FIG. 1. FIG. 12 is a schematic diagram showing functions of each component constituting the fuel supply system for a boat. The arrangement of each component (especially the location of a high-pressure fuel pump) in FIG. 12 is different from that in FIGS. 2 to 8. First, referring to FIGS. 1 to 12, a structure of an outboard motor 1 provided with a fuel supply system for a boat according to a preferred embodiment of the present invention will be described.

As shown in FIG. 1, the outboard motor 1 includes an engine section 2, a drive shaft 3 that is rotated by the driving force of the engine section 2 and extends vertically, a forward/reverse changing mechanism 4 connected to a lower end of the drive shaft 3, a propeller shaft 5 that is connected to the forward/reverse changing mechanism 4 and extends horizontally, and a propeller 6 attached to a rear end portion of the propeller shaft 5. The engine section 2 is housed in a cowling 7. In an upper case 8 and a lower case 9 arranged below the cowling 7, the drive shaft 3, the forward/reverse changing mechanism 4, and the propeller shaft 5 are housed. The outboard motor 1 is mounted to a transom plate 101 provided on a reverse direction (direction of an arrow "A") side of a hull 100 via a clamp bracket 10. The clamp bracket 10 supports the outboard motor 1 pivotally around a tilt shaft 10*a* in a vertical direction with respect to the hull 100. A fuel tank 102 for holding fuel (gasoline) is provided on the hull 100. Note that the fuel tank 102 is an example of the "first fuel tank" according to a preferred embodiment of the present invention. The fuel tank 102 and the engine section 2 of the outboard motor 1 are connected by a fuel pipe (not shown). The engine section 2 of the outboard motor 1 is driven by using fuel supplied from the fuel tank 102. The propeller 6 is rotated by the driving force of the engine section 2, and a rotational direction of the propeller 6 is changed by the forward/reverse changing mechanism 4. Thus, the hull 100 is propelled in a forward direction (direction of an arrow "B") or in a reverse direction (direction of the arrow "A"). A vent 7*a* is provided on a reverse direction (direction of the arrow "A") side of the cowling 7. Air supplied to the engine section 2 is taken into the engine section 2 in the cowling 7 via the vent 7*a*.

As shown in FIGS. 2 to 5, the engine section 2 includes an engine 20, an intake system 30 for supplying air to the engine 20, a fuel system 40 for supplying fuel to the engine 20, and an ECU (Engine Control Unit) 50 (see FIG. 12). The engine 20 is an example of the "engine" of the present invention.

Figure 2:
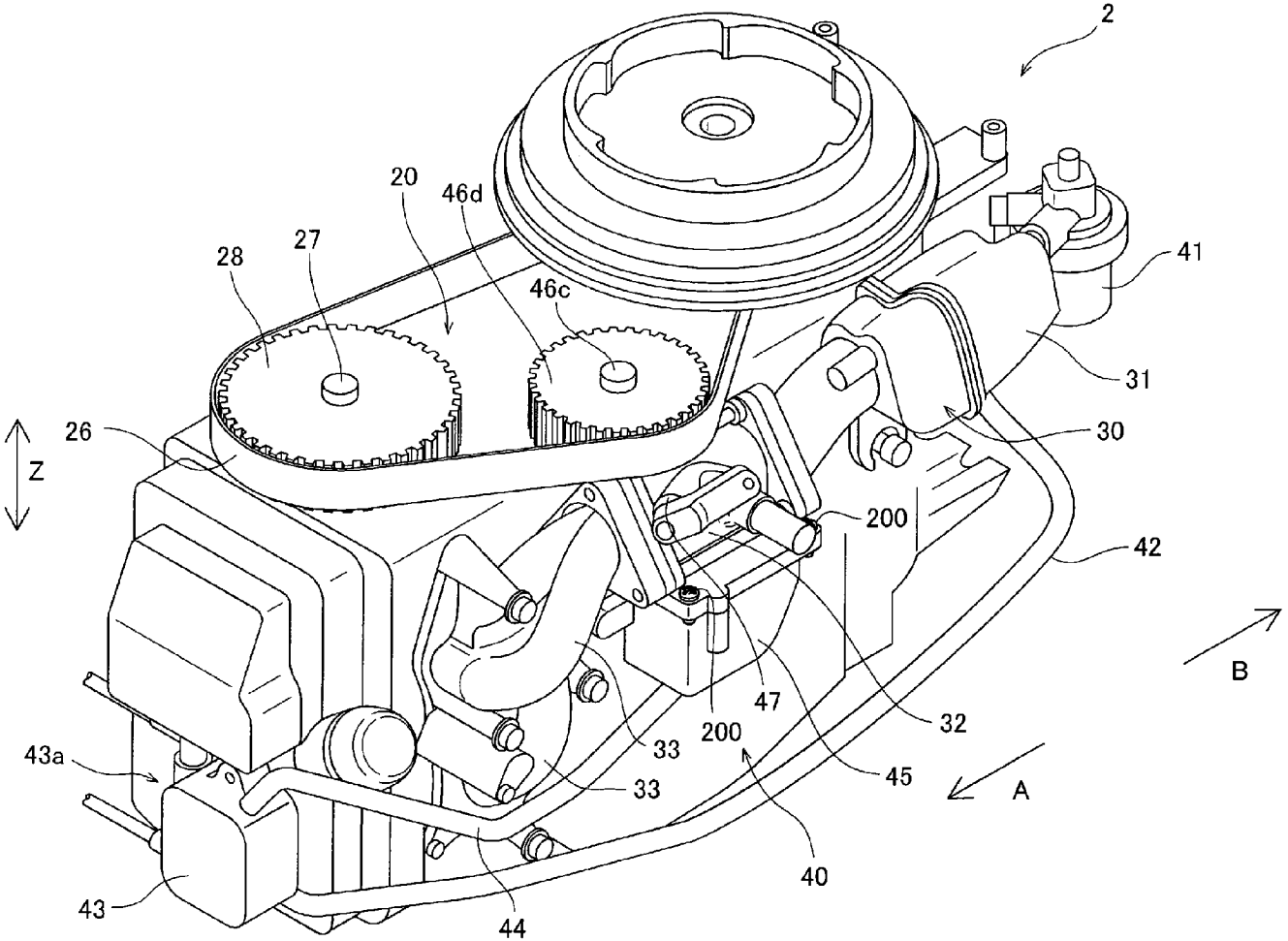
FIG. 2 is a perspective view showing an engine section of the outboard motor shown in FIG. 1.
Figure 3:
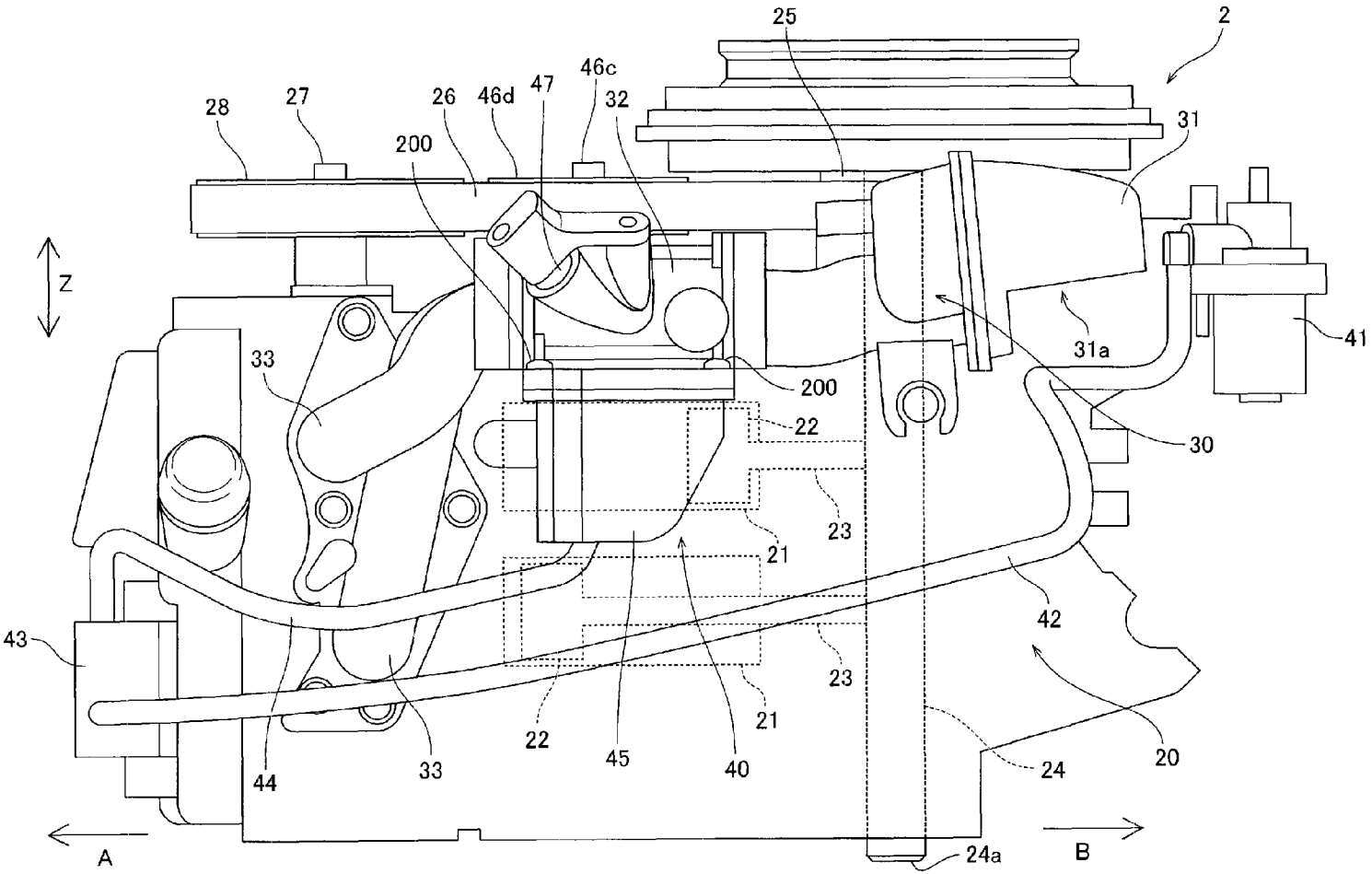
FIG. 3 is a side view showing the engine section of the outboard motor shown in FIG. 1.
Figure 4:
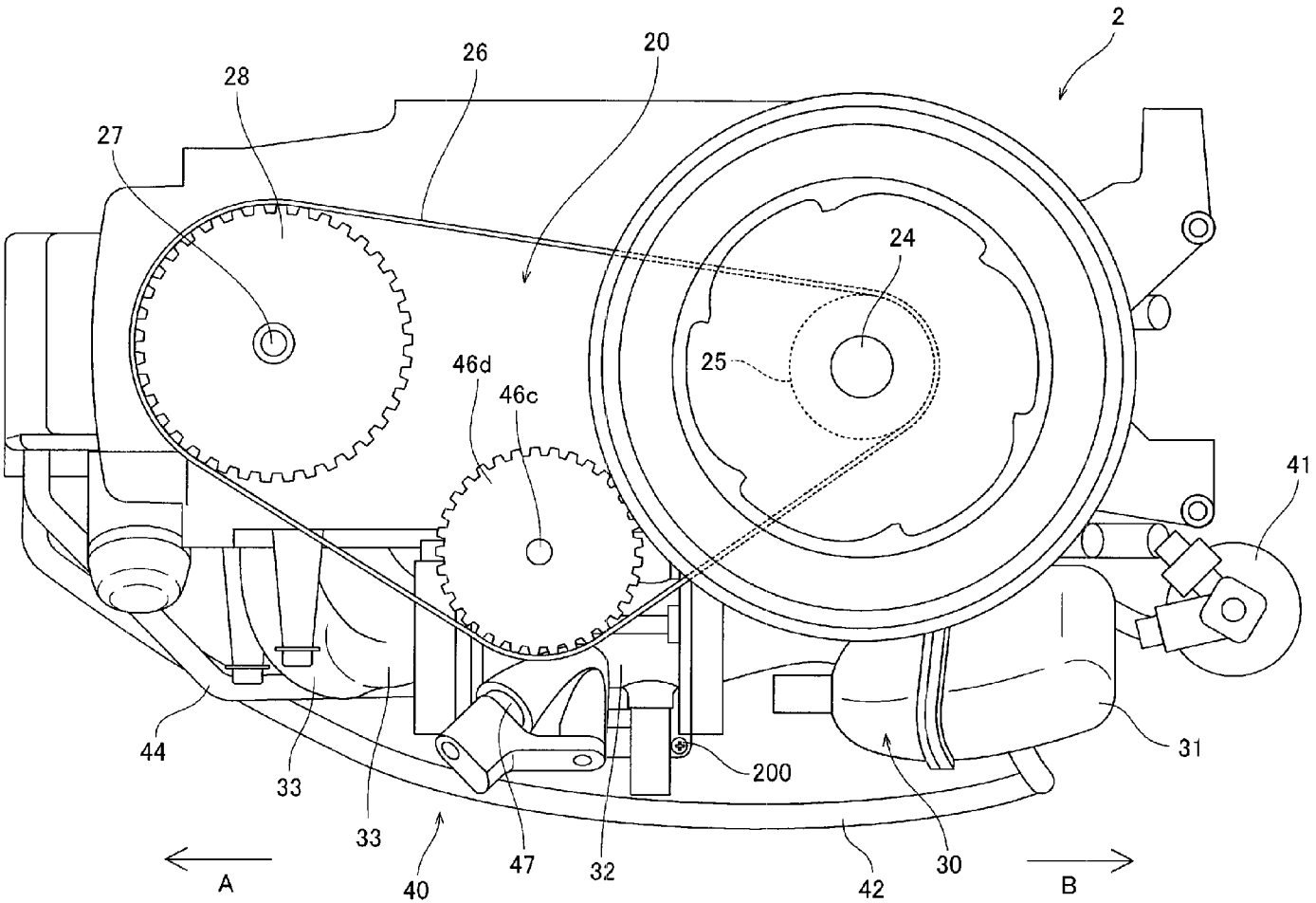
FIG. 4 is a top view showing the engine section of the outboard motor shown in FIG. 1.

As shown in FIG. 3, the engine 20 includes two cylinders 21 that are disposed parallel in a vertical direction ("Z" direction) and two pistons 22 that reciprocate horizontally in each of the cylinders 21. Each of the pistons 22 is connected to a crankshaft 24 extending in the vertical direction ("Z" direction) via a connecting rod 23. The horizontal reciprocating motion of the piston 22 is converted to the rotational motion by the connecting rod 23 and the crankshaft 24. A lower end portion 24*a* of the crankshaft 24 is connected to the drive shaft 3 (see FIG. 1). As shown in FIGS. 2 to 5, rotation of the crankshaft 24 is transmitted to a camshaft 27 by a pulley 25 fixed at the top of the crankshaft 24, a belt 26, and a pulley 28 fixed to the camshaft 27. An intake valve (not shown) and an exhaust valve (not shown) of each of the cylinders 21 are driven at predetermined timings by the rotation of the camshaft 27.

Figure 5:
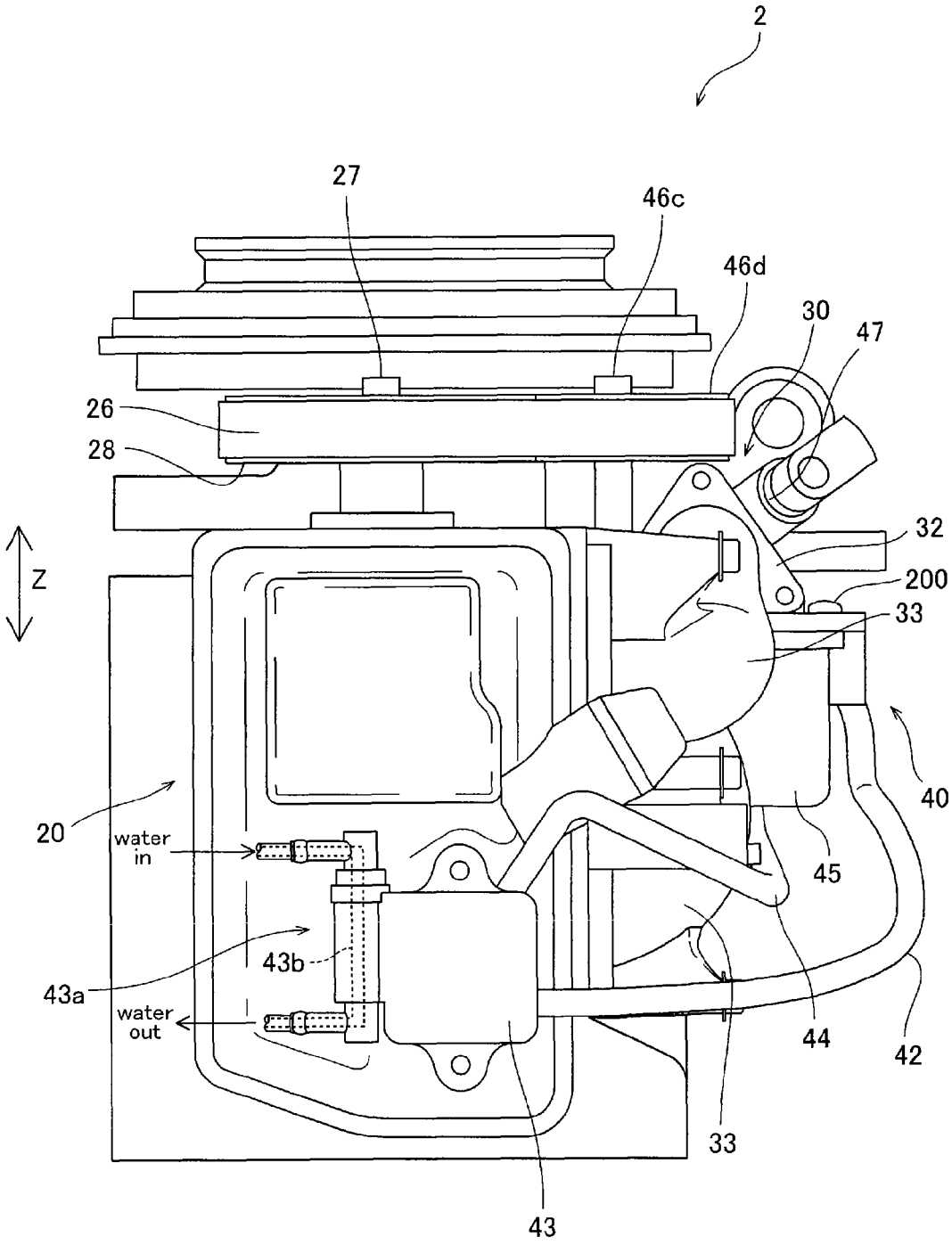
FIG. 5 is a front view showing the engine section of the outboard motor shown in FIG. 1.

As shown in FIGS. 2 and 5, the intake system 30 is disposed on the right of the engine 20 when seen in the forward direction (direction of the arrow "B") of the engine 20. The intake system 30 includes a silencer case 31 that is disposed in a forward direction (direction of the arrow "B") side and has an inlet 31*a* (see FIG. 3), a throttle body 32 connected to the silencer case 31, and two intake pipes 33 respectively connected to an intake port (not shown) of each of the two cylinders 21 of the engine 20.

As shown in FIGS. 6 to 8 and FIG. 12, the throttle body 32 is preferably formed of resin or metal and has a cylindrical air passage 32*a*. A butterfly-type throttle valve 32*b* (see FIGS. 8 and 12) is provided in the air passage 32*a*. As shown in FIG. 12, a bypass air passage 32*c* arranged to connect an upstream side and a downstream side of the air passage 32*a* relative to the throttle valve 32*b* is provided in the throttle body 32. The bypass air passage 32*c* provides an air flow rate during idling when the throttle valve 32*b* is completely closed. Also, in the bypass air passage 32*c*, an ISC (Idle Speed Control) unit 34 that has a valve to control the air flow rate in the bypass air passage 32*c* is provided. Engine speed during idling can be controlled by adjusting the opening degree of the valve of the ISC unit 34. The throttle body 32 also has a throttle opening sensor 35 arranged to detect the opening degree of the throttle valve 32*b*, an intake air pressure sensor 36 arranged to detect air pressure in the air passage 32*a*, and an intake air temperature sensor 37 arranged to detect the air temperature in the air passage 32*a*. The ISC unit 34 and a sensor section 38 including the throttle opening sensor 35, the intake air pressure sensor 36, and the intake air temperature sensor 37 are attached to an upper portion of the throttle body 32.

As shown in FIGS. 2 to 6 and FIG. 12, the fuel system 40 includes a filter 41 connected to the fuel tank 102 disposed on the hull 100, a low-pressure fuel pump 43 connected to the filter 41 via a fuel pipe 42 preferably made of rubber or resin, a vapor separator tank 45 connected to the low-pressure fuel pump 43 via a fuel pipe 44 preferably made of rubber or resin, a high-pressure fuel pump 46 (see FIG. 6) arranged to transport fuel reserved in the vapor separator tank 45, and an injector 47 arranged to inject the fuel transported by the high-pressure fuel pump 46. Note that the vapor separator tank 45, the high-pressure fuel pump 46, and the injector 47 respectively are examples of the "second fuel tank," the "fuel supply pump," and the "fuel injection device" according to a preferred embodiment of the present invention.

As shown in FIG. 5, the low-pressure fuel pump 43 preferably is a so-called diaphragm type fuel pump including a piston (not shown) and a diaphragm (not shown). The piston of the low-pressure fuel pump 43 is configured to be reciprocated in conjunction with rotation of a cam (not shown) attached to the camshaft 27 of the engine 20 (see FIG. 2). The diaphragm is configured to be reciprocated corresponding to the reciprocation of the piston, thereby transporting fuel. A water-cooling section 43*a* is provided on a side portion of the low-pressure fuel pump 43. The water-cooling section 43*a* has a pipe 43*b* extending along the side portion of the low-pressure fuel pump 43 and allows the pipe 43*b* to flow sea water, thereby cooling the low-pressure fuel pump 43. Since the fuel that is pumped up from the fuel tank 102 on the hull 100 by the low-pressure fuel pump 43 passes through the filter 41, foreign matters and the like contained in the fuel are eliminated.

Figure 6:
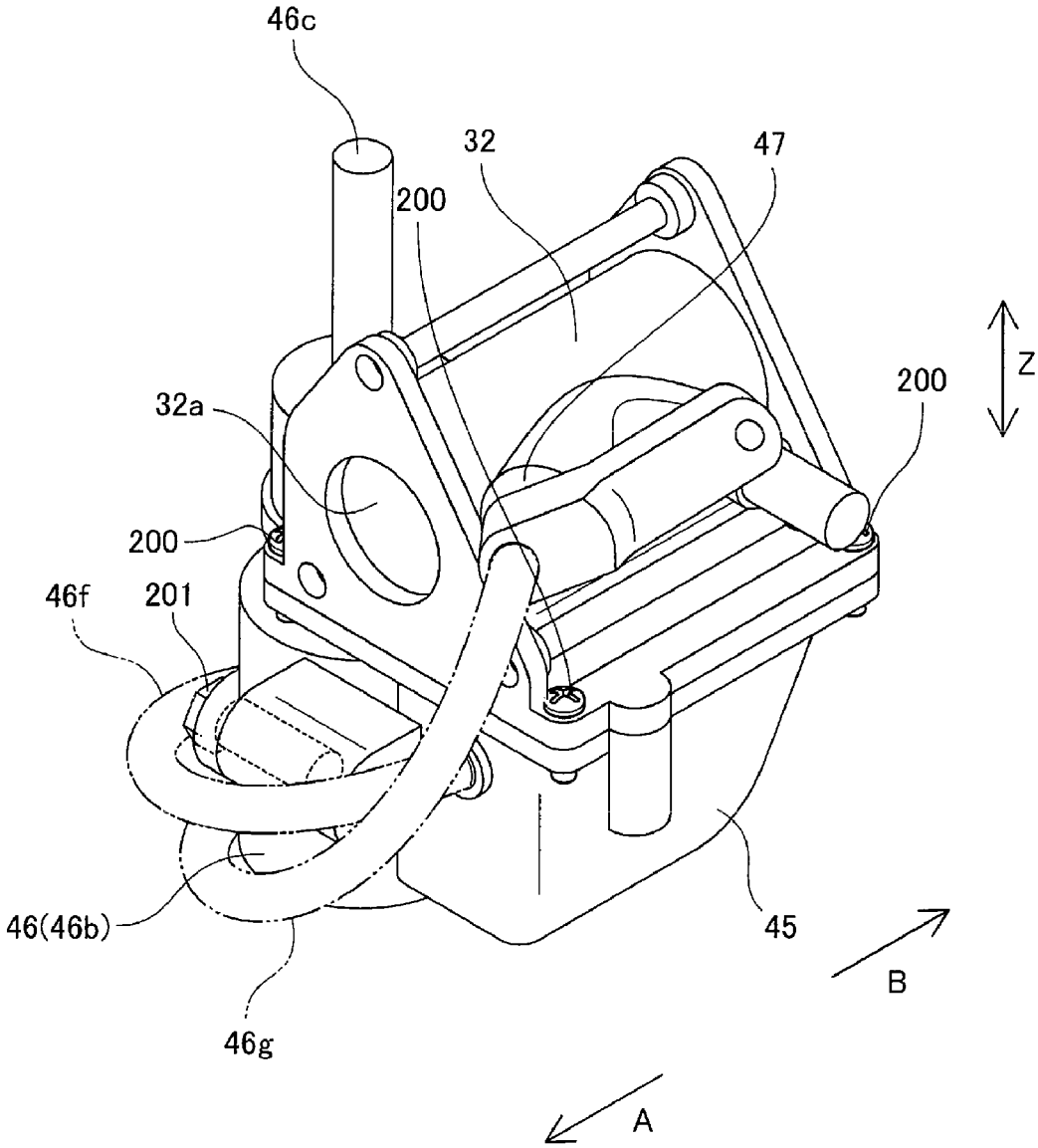
FIG. 6 is a perspective view showing a throttle body and its vicinity in the engine section of the outboard motor shown in FIG. 1.
Figure 7:
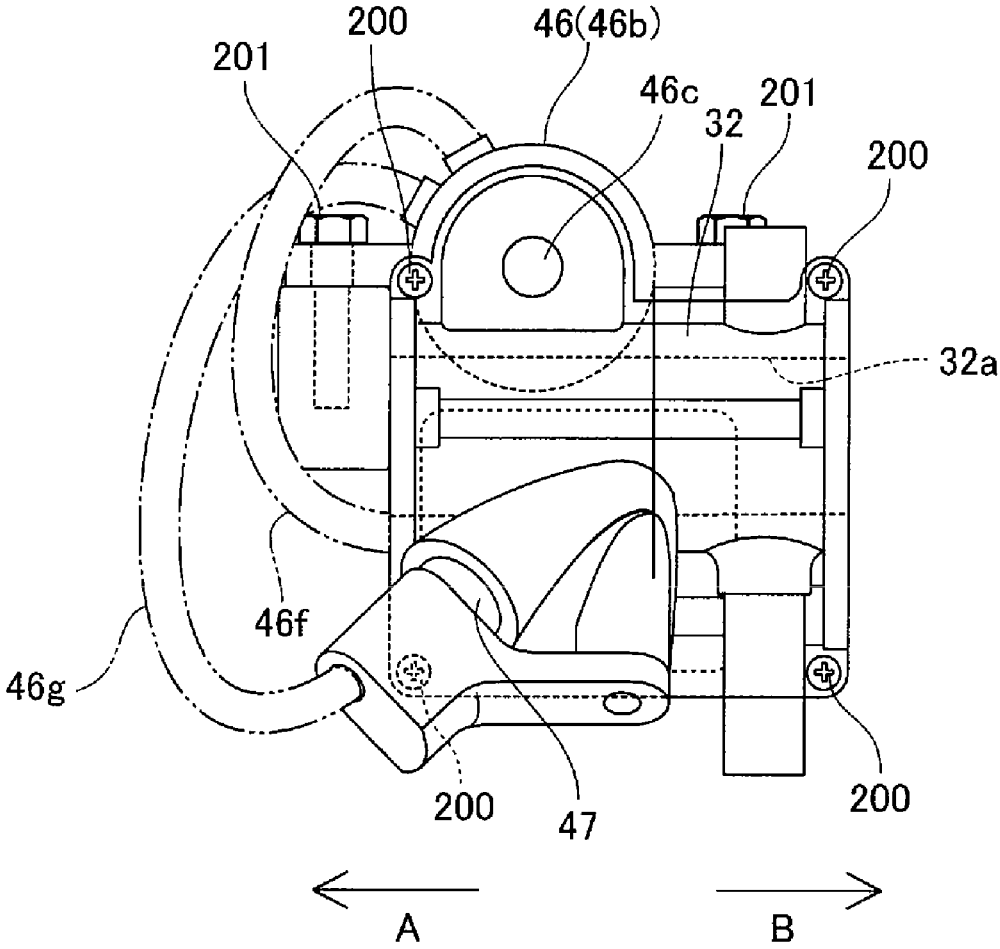
FIG. 7 is a top view showing the throttle body and its vicinity in the engine section of the outboard motor shown in FIG. 1.
Figure 8:
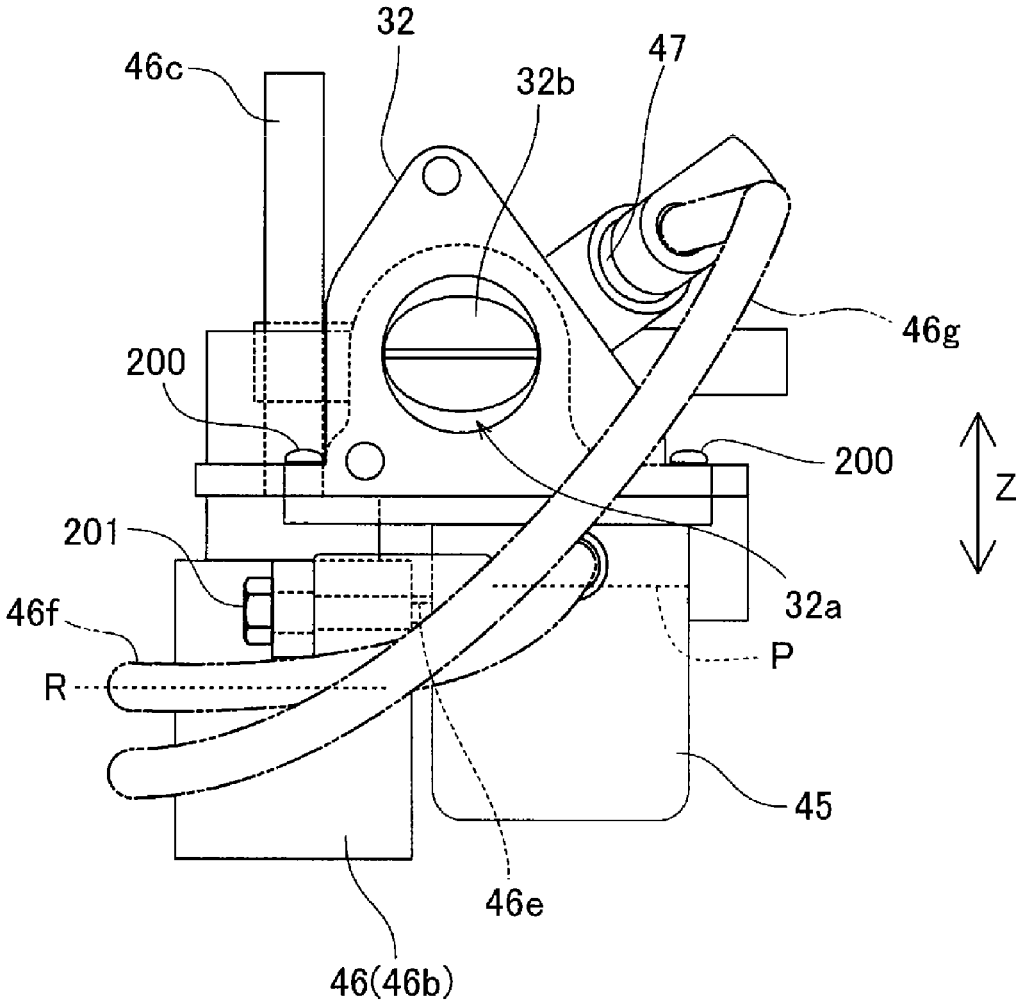
FIG. 8 is a front view showing the throttle body and its vicinity in the engine section of the outboard motor shown in FIG. 1.

The fuel sent out by the low-pressure fuel pump 43 is discharged from an outlet 45*a* (see FIG. 12) via the fuel pipe 44 is reserved in the vapor separator tank 45. The vapor separator tank 45 is preferably formed of resin and disposed adjacent to and below the throttle body 32 to contact with the throttle body 32. In this preferred embodiment, as shown in FIGS. 6 to 8, the throttle body 32 and the vapor separator tank 45 preferably are fixedly joined by four screws 200, for example.

The vapor separator tank 45 holds the fuel pumped up from the fuel tank 102 and separates the vaporized fuel (vapor) or air from the liquid fuel. As shown in FIG. 12, the vapor separator tank 45 is configured such that the quantity of the reserved fuel in the tank is kept constant and the fuel level "P" in the tank is kept at a predetermined level. Specifically, a float 45*c* that is pivotable about a pivot shaft 45*b* in the vertical direction ("Z" direction) is provided in the vapor separator tank 45. A needle valve 45*d* is provided in the float 45*c* at a position corresponding to the outlet 45*a*. Since the float 45*c* moves in the vertical direction as the fuel level "P" in the vapor separator tank 45 moves, the needle valve 45*d* moves in the vertical direction corresponding to the movement of the float 45*c*. When the fuel level "P" in the vapor separator tank 45 becomes higher than the predetermined level, the float 45*c* ascends to insert the needle valve 45*d* in the outlet 45*a*, thereby automatically stopping inflow of fuel into the vapor separator tank 45. When the fuel level "P" in the vapor separator tank 45 is lower than the predetermined level, the float 45*c* descends to separate the needle valve 45*d* from the outlet 45*a*, thereby automatically allowing inflow of fuel into the vapor separator tank 45. With the above described mechanism, the quantity of the reserved fuel in the vapor separator tank 45 is kept constant, and the fuel level "P" in the tank is kept at the predetermined level.

At the bottom of the vapor separator tank 45, there is provided a water sensor 45*e* to detect water collected at the bottom of the vapor separator tank 45. Specifically, a central portion 45*f* of the bottom of the vapor separator tank 45 is protruded upward. The protruded portion defines a recess as seen from the outside below the vapor separator tank 45. Two leads 451, 452 are disposed in the recess, and tips of the leads 451, 452 are connected to each other. Also, a pair of floats 45*g* that are floatable in water are provided at the bottom of the vapor separator tank 45. Each of the paired floats 45*g* has a built-in magnet (not shown). When water is collected at the bottom of the vapor separator tank 45, the float 45*g* having a magnet ascends as a water level "Q" ascends. When the floats 45*g* ascend up to a predetermined position, the tip of the lead 451 and the tip of the lead 452 are separated from each other by magnetic force of the magnets. Accordingly, the connection between the leads 451, 452 is broken. With the water sensor 45*e* configured as above, it is possible to detect whether or not water is collected in an equal or greater quantity than a predetermined quantity at the bottom of the vapor separator tank 45.

A leading end 46*h* of a pipe 46*f* is inserted in an upper portion of the vapor separator tank 45. The pipe 46*f* is connected to the high-pressure fuel pump 46, which will be described later. The fuel returned from the high-pressure fuel pump 46 is discharged from the leading end 46*h* of the pipe 46*f* into the vapor separator tank 45. A buffer plate 45*h* is disposed below the leading end 46*h* of the pipe 46*f* and above the float 45*c* in the vapor separator tank 45. A plurality of small holes are provided in the buffer plate 45*h*. Fuel that is discharged from the leading end 46*h* of the pipe 46*f* is reserved again in the vapor separator tank 45 via the holes of the buffer plate 45*h*. When the fuel discharged from the leading end 46*h* of the pipe 46*f* bubbles, the buffer plate 45*h* can drip the liquid fuel into the vapor separator tank 45 without dropping bubbles.

The vapor separator tank 45 and the throttle body 32 are connected via a check valve 45*i*. The check valve 45*i* is configured to pass vapor (vaporized fuel) or air only in one direction from the vapor separator tank 45 to the throttle body 32. When vapor occurs, and thus internal pressure of the vapor separator tank 45 increase, the check valve 45*i* is opened by the pressure to discharge the vapor from the vapor separator tank 45 to the throttle body 32. Also, when the engine (engine section 2) is operated, the negative pressure in the throttle body 32 opens the check valve 45*i* to discharge the vapor from the vapor separator tank 45 to the throttle body 32.

Figure 9:
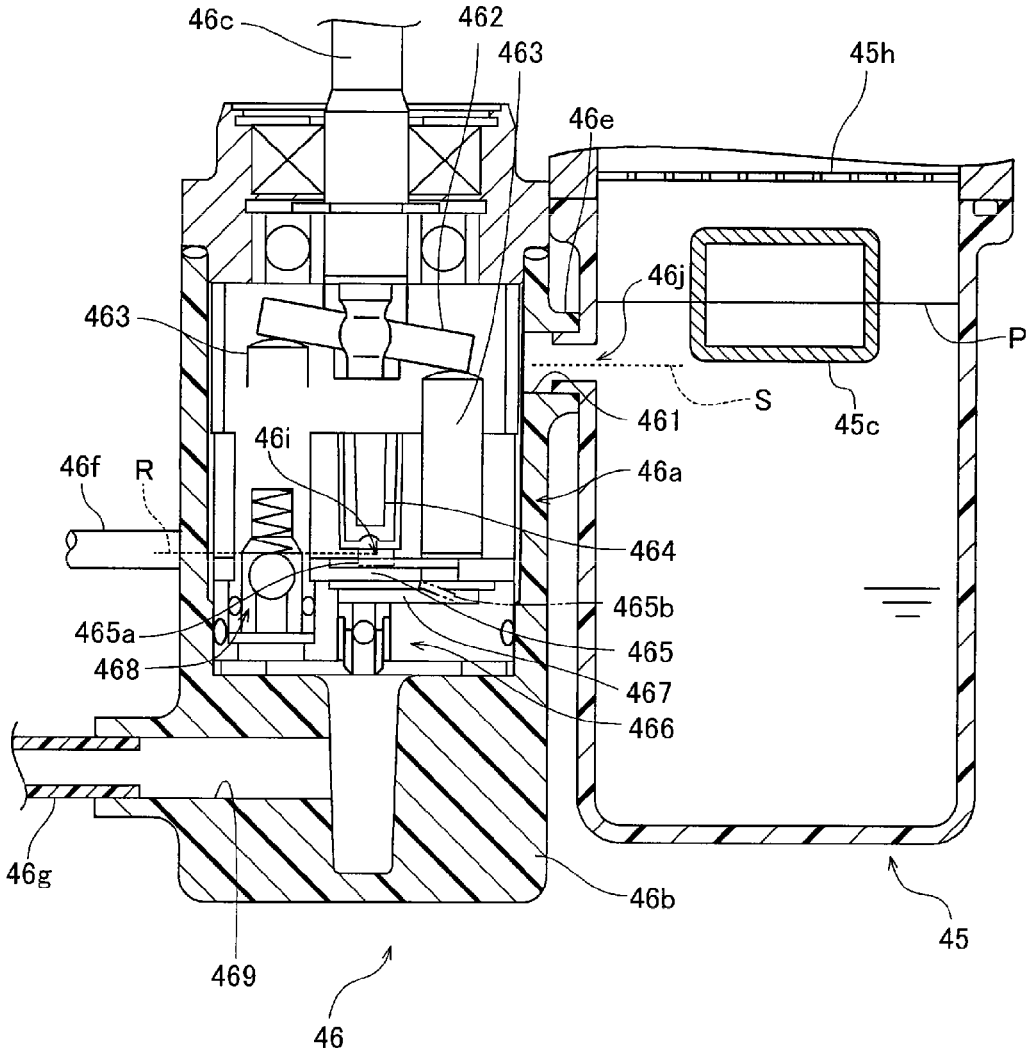
FIG. 9 is a partial sectional view showing the internal structure of a high-pressure fuel pump in the engine section of the outboard motor shown in FIG. 1.

As shown in FIGS. 6 to 8, the high-pressure fuel pump 46 in this preferred embodiment is a so-called in-line fuel pump that is disposed outside the vapor separator tank 45 and interposed between the fuel pipes. The high-pressure fuel pump 46 is fixed to a side of the vapor separator tank 45 at two locations preferably by screws 201, for example. The high-pressure fuel pump 46 is preferably formed of resin as a base material. More specifically, as shown in FIG. 9, the high-pressure fuel pump 46 is configured such that a pump main portion 46*a* through which fuel passes is retained by an outer frame 46*b* preferably made of resin. The outer frame 46*b* is fixed to the vapor separator tank 45 by screws 201 (see FIGS. 7 and 8). The pump main portion 46*a* is configured to transport fuel by rotating a rotary shaft 46*c*. In this preferred embodiment, as shown in FIGS. 2 to 5, a pulley 46*d* is fixed at an upper end of the rotary shaft 46*c*. The pulley 46*d* meshes with the belt 26 together with the pulley 25 of the crankshaft 24 and the pulley 28 of the camshaft 27. Thus, as the crankshaft 24 is rotated by the driving force of the engine 20, the pulley 46*d* and the rotary shaft 46*c* are rotated to drive the pump main portion 46*a*. Note that the pulley 46*d* is an example of the "pump driving section" according to a preferred embodiment of the present invention.

Figure 10:
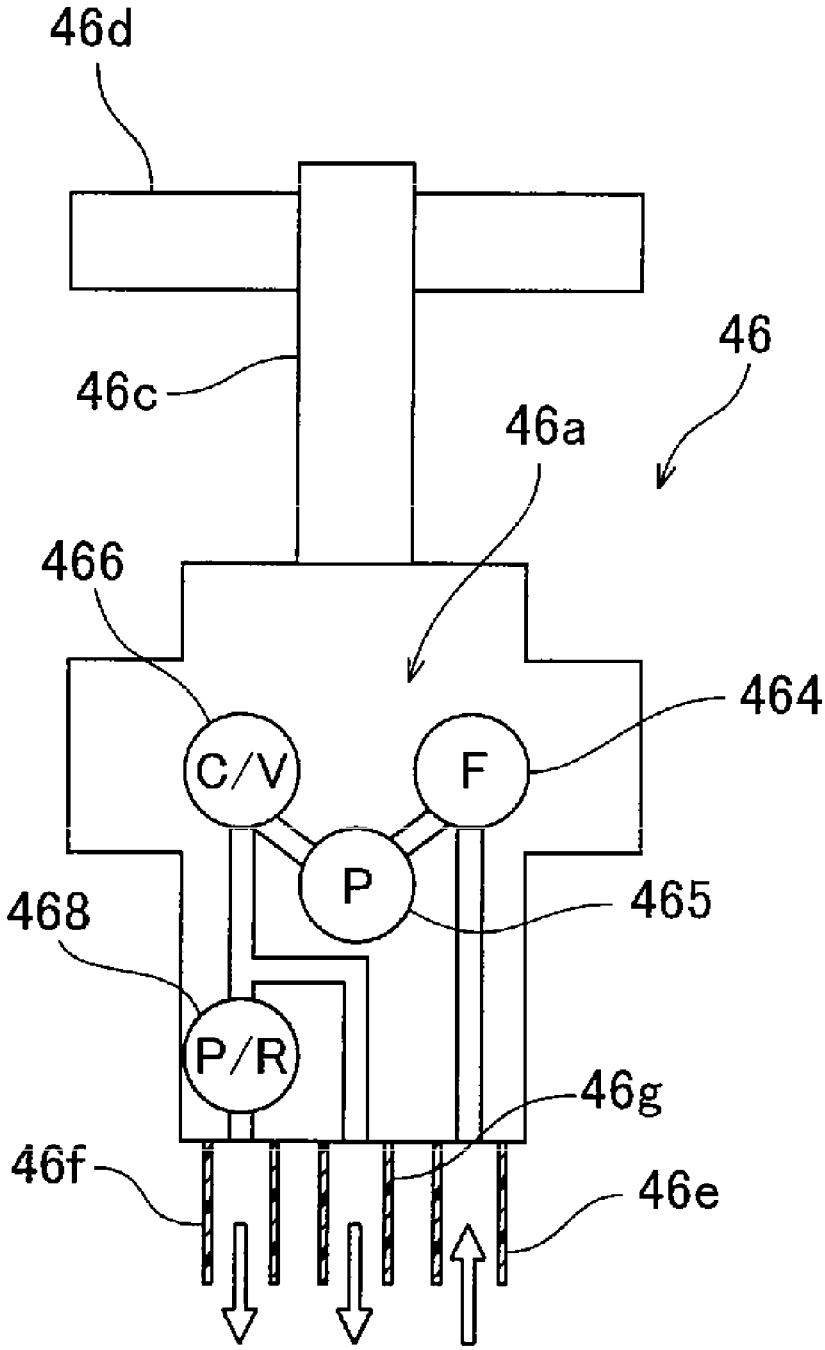
FIG. 10 is a schematic view showing the high-pressure fuel pump in the engine section of the outboard motor shown in FIG. 1.
Figure 11:
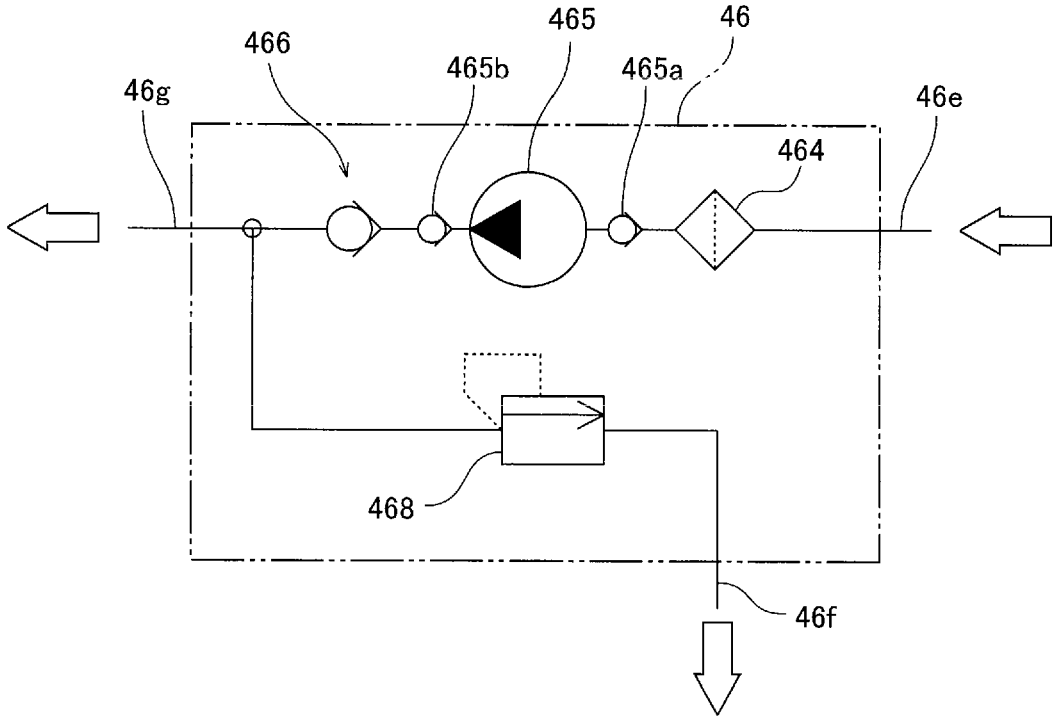
FIG. 11 is a hydraulic circuit diagram of the high-pressure fuel pump in the engine section of the outboard motor shown in FIG. 1.
Figure 12:
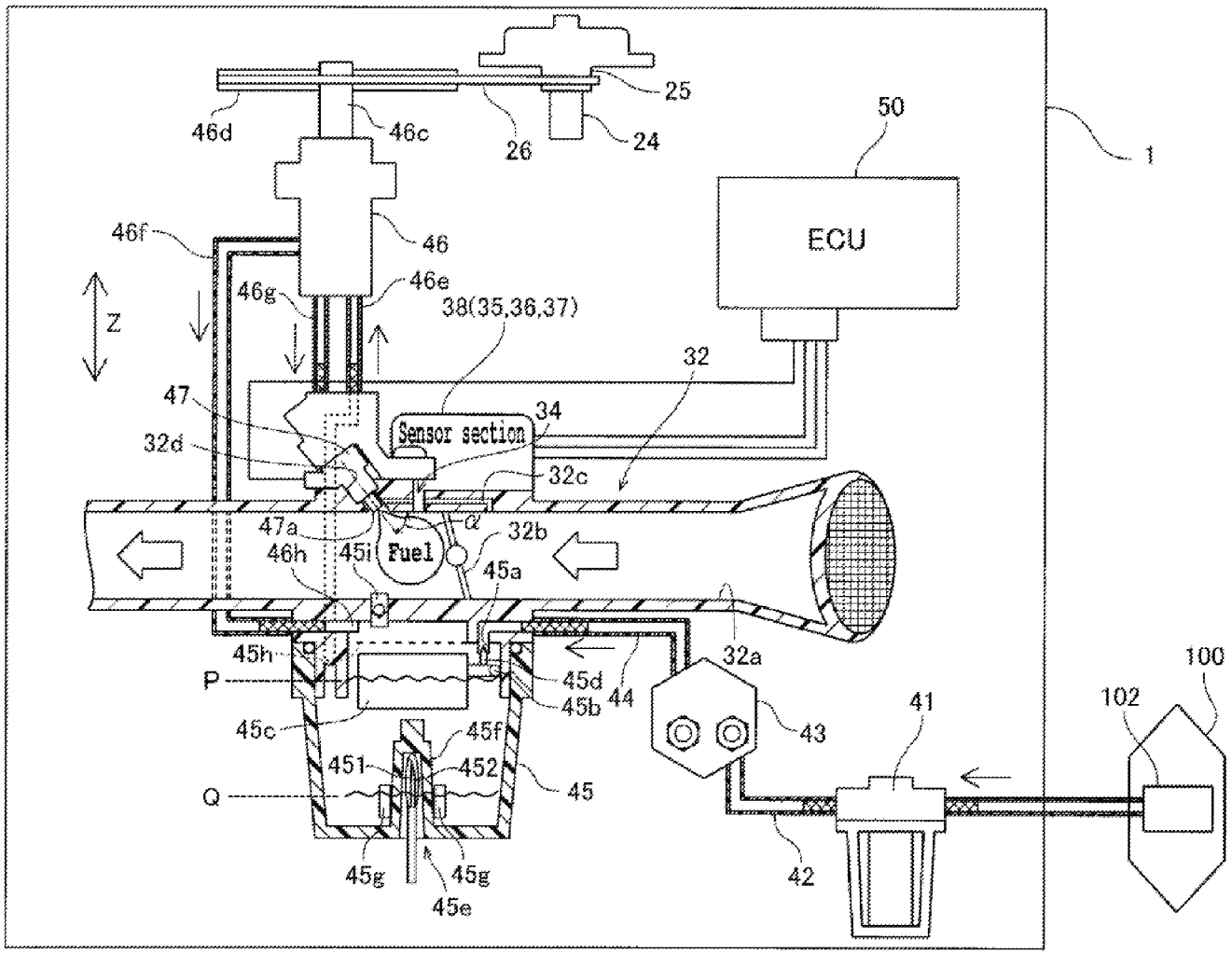
FIG. 12 is a schematic view showing a fuel supply system of the outboard motor in FIG. 1.

As shown in FIGS. 9 to 11, the pump main portion 46*a* preferably includes: an inlet 461 connected to the vapor separator tank 45 via a resinous pipe 46*e;* a swash plate 462 fixed aslant to the rotary shaft 46*c;* a plunger 463; a filter 464; a reserve chamber 465 arranged to temporarily store fuel; a reserve chamber 467 containing a fuel pressure retaining valve 466; a relief valve 468 connected to the vapor separator tank 45 via a resinous pipe 46*f;* and an outlet 469 connected to the injector 47 (see FIG. 12) via a resinous pipe 46*g*. The inlet 461, the filter 464, the reserving chamber 465, the reserving chamber 467, the relief valve 468, and the inlet 469 constitute an example of the "fuel path" according to a preferred embodiment of the present invention. Note that the swash plate 462 and the plunger 463 provide an example of the "negative pressure generating mechanism" according to a preferred embodiment of the present invention and the reserve chamber 465 is an example of the "reserving section" according to a preferred embodiment of the present invention. In addition, the relief valve 468 is an example of the "pressure adjustment device" according to a preferred embodiment of the present invention.

An upper end of the plunger 463 abuts on a lower surface of the swash plate 462. As the swash plate 462 rotates with the rotary shaft 46*c,* the plunger 463 reciprocates in a vertical direction. When the plunger 463 moves upward, fuel is drawn from the vapor separator tank 45 into the reserving chamber 465 via the inlet 461 and the filter 464. When the plunger 463 moves downward, fuel is pushed out from the reserving chamber 465 to the reserving chamber 467. There are provided a lead valve 465*a* and a lead valve 465*b* respectively between the filter 464 and the reserving chamber 465 and between the reserving chamber 465 and the reserving chamber 467. These valves open when fuel flows in a transport direction (direction from the inlet 461 to the outlet 469) and close when fuel attempts to flow in the opposite direction. Note that the lead valves 465*a* and 465*b* are an example of the "first check valve" and the "second check valve" according to a preferred embodiment of the present invention. When fuel is drawn from the filter 464 into the reserving chamber 465, the lead valve 465*a* opens and the lead valve 465*b* closes at the same time as the plunger 463 moves upward. When fuel is pushed out from the reserving chamber 465 to the reserving chamber 467, the lead valve 465*a* closes and the lead valve 465*b* opens at the same time as the plunger 463 moves downward.

Also, when fuel is drawn from the filter 464 into the reserving chamber 465, the plunger 463 moves upward to generate negative pressure in a negative pressure generating portion 46*i* in the vicinity (between the filter 464 and the reserving chamber 467) of the lead valve 465*a*. The negative pressure generating portion 46*i* is positioned at a height "R." In this preferred embodiment, as shown in FIGS. 8 and 9, the high-pressure fuel pump 46 is configured such that the height "R" of the negative pressure generating portion 46*i* is positioned lower than the fuel level "P" in the vapor separator tank 45 and a height "S" of a suction opening 46*j* (see FIG. 9) of the pipe 46*e*. A vertical interval between the height "R" of the negative pressure generating portion 46*i* and the fuel level "P" is set corresponding to the magnitude of negative pressure (suction force) generated when the high-pressure fuel pump 46 draws fuel. That is, when the negative pressure (suction force) of the high-pressure fuel pump 46 is high, the vertical interval between the height "R" of the negative pressure generating portion 46*i* in the high-pressure fuel pump 46 and the fuel level "P" is adapted to be large. In contrast, when the negative pressure (suction force) of the high-pressure fuel pump 46 is low, the vertical interval between the height "R" of the negative pressure generating portion 46*i* in the high-pressure fuel pump 46 and the fuel level "P" is adapted to be small or generally zero. When the pressure of the fuel reserved in the reserving chamber 467 becomes equal to or larger than a predetermined value, the fuel is discharged from the outlet 469 via the fuel pressure retaining valve 466. The outlet 469 is connected to the relief valve 468. When pressure at the outlet 469 increases excessively in such a case that the injector 47 (see FIG. 12) is plugged with fuel, fuel is discharged into the vapor separator tank 45 (see FIG. 12) via the relief valve 468 and the pipe 46*f*.

As shown in FIG. 12, the injector 47 has a function to inject the fuel that is sent out at predetermined pressure by the high-pressure fuel pump 46 at predetermined timing. In this preferred embodiment, the injector 47 is inserted in a mounting hole 32*d* of the throttle body 32 for mounting. The injector 47 is configured to inject fuel in a direction opposite to an airflow direction in the air passage 32*a* of the throttle body 32. The direction of the fuel injection is tilted at an angle of a (about 20 degrees to about 60 degrees, for example) relative to the airflow direction. Fuel injection in the opposite direction to the airflow direction allows the injected fuel to be atomized and spread evenly throughout the air passage 32*a* and prevents the fuel from attaching to an inner surface of the air passage 32*a*. An injection nozzle 47*a* of the injector 47 is disposed in a downstream vicinity of the throttle valve 32*b*. Fuel is injected from the injection nozzle 47*a* of the injector 47 toward the throttle valve 32*b*. Also, the injection nozzle 47*a* of the injector 47 is positioned at an exit of the bypass air passage 32*c*. Thus, fuel is injected into a faster portion of the airflow. This facilitates fuel atomization. In this preferred embodiment, with the above configuration, fuel can be distributed evenly to the two intake pipes 33 by the single injector 47.

In this preferred embodiment, as described above, the high-pressure fuel pump 46 is configured such that the negative pressure generating portion 46*i* that generates negative pressure as a suction force when the high-pressure fuel pump 46 draws fuel is positioned lower than the fuel level "P" in the vapor separator tank 45. This makes it possible to draw fuel into the high-pressure fuel pump 46 with a small negative pressure. That is, when the negative pressure generating portion 46*i* is positioned higher than the fuel level "P" in the vapor separator tank 45, a large negative pressure is required to draw fuel from the vapor separator tank 45 into the high-pressure fuel pump 46 because the fuel needs to be lifted up to a position higher than the fuel level "P" in the vapor separator tank 45. In contrast, when the negative pressure generating portion 46*i* is positioned lower than the fuel level "P" in the vapor separator tank 45, fuel can be drawn into the high-pressure fuel pump 46 with a small negative pressure because no force is required to move the fuel to the negative pressure generating portion 46*i*. Thus, negative pressure applied on the fuel can be reduced, thereby preventing the fuel in the high-pressure fuel pump 46 from vaporizing due to boiling under reduced pressure caused by an increase of the negative pressure while drawing the fuel. As a result, deterioration in the startability of the engine section 2 can be prevented.

In this preferred embodiment, as described above, the high-pressure fuel pump 46 is preferably disposed outside the vapor separator tank 45. Accordingly, the high-pressure fuel pump 46 can be easily arranged such that the negative pressure generating portion 46*i* is positioned lower than the fuel level "P."

In this preferred embodiment, as described above, the high-pressure fuel pump 46 is preferably disposed on the side of and adjacent to the vapor separator tank 45. Therefore, the pipe 46*f* for connecting the high-pressure fuel pump 46 and the vapor separator tank 45 can be shortened, thereby decreasing a heat-receiving area that receives radiated heat from the engine 20. This prevents an increase in the fuel temperature in the pipe 46*f* for connecting the high-pressure fuel pump 46 and the vapor separator tank 45, and thereby prevents generation of vapor in the high-pressure fuel pump 46 caused by an increase in the fuel temperature which is a factor of the generation of vapor.

In this preferred embodiment, as described above, the high-pressure fuel pump 46 is fixed to the vapor separator tank 45, and is not directly supported by the high-temperature engine 20. Therefore, differing from the case where the high-pressure fuel pump 46 is supported by the engine 20 via supporting members, it is possible to prevent an increase in the temperature of the high-pressure fuel pump 46 caused by heat directly transmitted from the engine 20 via the supporting members.

In this preferred embodiment, as described above, the vapor separator tank 45 and the high-pressure fuel pump 46 preferably are disposed adjacent to the throttle body 32. Accordingly, the vapor separator tank 45 and the high-pressure fuel pump 46 that receives radiated heat from the engine 20 can be cooled by the throttle body 32 in relatively low temperature. More specifically, since air flows fastest in the throttle body 32, heat is rapidly absorbed by the air flowing fast or by vaporization of the injected fuel. As a result, the throttle body 32 becomes resistant to temperature increases. Being disposed adjacent to the throttle body 32 in relatively low temperature, the vapor separator tank 45 and the high-pressure fuel pump 46 that receives radiated heat from the engine 20 can be cooled by the throttle body 32 in relatively low temperature. Thus, the temperature increase in the vapor separator tank 45 and the high-pressure fuel pump 46 can be prevented, thereby preventing generation of vapor (vaporized fuel) in the vapor separator tank 45 and the high-pressure fuel pump 46.

In this preferred embodiment, as described above, the injector 47 is preferably configured to be disposed adjacent to the throttle body 32 and inject fuel in the throttle body 32. Thus, each of the vapor separator tank 45, the high-pressure fuel pump 46, and the injector 47 can be disposed in the vicinity of the throttle body 32. Since the fuel system 40 is thus disposed within a small space, the pipes 46*e*, 46*f*, 46*g* arranged to connect the vapor separator tank 45, the high-pressure fuel pump 46, and the injector 47 can be shortened. This decreases a heat-receiving area that receives radiated heat from the engine 20, thereby preventing generation of vaporized fuel. Since the fuel system 40 is disposed within a small space, the outboard motor 1 can be made compact.

In this preferred embodiment, as described above, the relief valve 468 is provided in the high-pressure fuel pump 46. Therefore, in such a case that the injector 47 is plugged with fuel, fuel can be discharged via the relief valve 468 contained in the high-pressure fuel pump 46. This prevents the injector 47 and the high-pressure fuel pump 46 from being damaged by the excessive fuel pressure.

In this preferred embodiment, as described above, when the pressure of the fuel supplied to the injector 47 becomes equal to or larger than the predetermined value, the fuel is returned to the vapor separator tank 45 via the relief valve 468 and the pipe 46*f*. Accordingly, when the fuel temperature rises and vapor occurs in the pump main portion 46*a*, the vapor is returned to the vapor separator tank 45 where the vapor and the liquid fuel can be separated. This prevents vapor from collecting in the pump main portion 46*a* of the high-pressure fuel pump 46, thereby preventing uncontrolled fuel supply to the injector 47 that is caused from the collected vapor in the pump main portion 46*a*.

In this preferred embodiment, as described above, the pump main portion 46*a* having a fuel path is preferably driven by the pulley 46*d* separated from the fuel path. Thus, differing from the case where the high-pressure fuel pump 46 is driven by a motor through which fuel passes, the high-pressure fuel pump 46 can be prevented from generating heat. This prevents an increase in the fuel temperature in the high-pressure fuel pump 46. Accordingly, generation of vapor (vaporized fuel) in the high-pressure fuel pump 46 can be prevented.

In this preferred embodiment, as described above, the pump main portion 46*a* is preferably driven by the driving force of the engine 20 using the rotary shaft 46*c* and the pulley 46*d* without providing an extra driving source such as a motor to drive the pump main portion 46*a*.

Note that the above preferred embodiment is only an example in every aspect, and it should not be considered to limit the present invention. The scope of this invention is not defined by the aforementioned description of the above preferred embodiment, but by the claims. Also the scope of this invention includes every modification within the equivalent meaning and scope of the claims.

Figure 13:
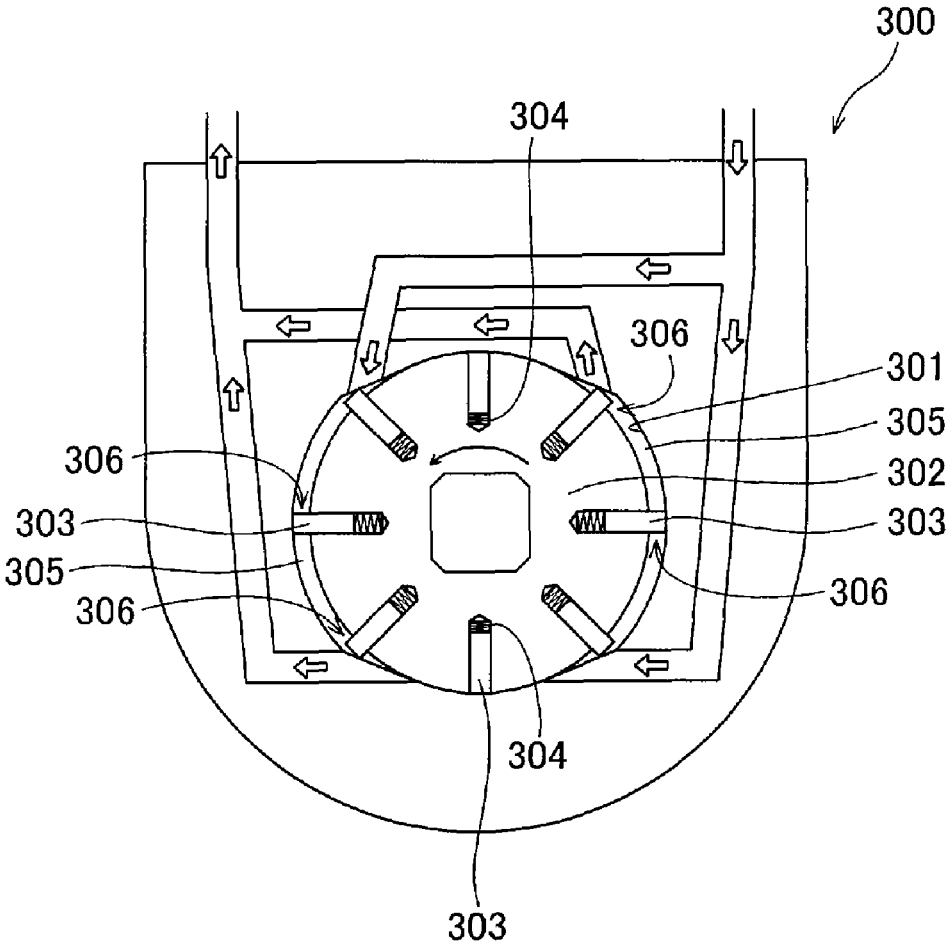
FIG. 13 is a schematic view showing a high-pressure fuel pump of an outboard motor according to a first variation of preferred embodiments of the present invention.

For example, in the above preferred embodiment, the high-pressure fuel pump 46 preferably transports fuel by driving the plunger 463 with the swash plate 462. However, the present invention is not limited thereto. Other types of the high-pressure fuel pump such as a vane-type pump, a screw-type pump, or a trochoid-type pump may be used. In the case where such a fuel pump as mentioned above is employed, the high-pressure fuel pump can also be configured in such a manner that a negative pressure generating portion in the high-pressure pump is positioned generally at a same level as or lower than the fuel level "P" in a vapor separator tank. Further, if there are provided a plurality of negative pressure generating portions in the high-pressure fuel pump, all the plurality of negative pressure generating portions are preferably positioned generally at a same level as or lower than the fuel level "P" in a vapor separator tank. For example, a vane-type high-pressure fuel pump 300 according to a first variation as shown in FIG. 13 includes a casing 301, a rotor 302 rotating in the casing 301, a plurality of vanes 303 provided on the rotor 302, and springs 304 for outwardly urging the plurality of vanes 303, respectively. In given spaces between the casing 301 and the rotor 302, there are provided gaps 305 where the vanes 303 scrape out fuel and transport the fuel. In the vane-type high-pressure fuel pump 300, backside portions (portions of the vanes 303 in the vicinity opposite to a rotational direction of the rotor 302) of the vanes 303 relative to a rotational direction of the rotor 302 act as negative pressure generating portions 306.

In the above preferred embodiment, the high-pressure fuel pump 46 is preferably configured in such a manner that the negative pressure generating portion 46*i* is positioned lower than the fuel level "P" in the vapor separator tank 45. However, the present invention is not limited thereto. When the negative pressure generated in the negative pressure generating portion 46*i* is small, the negative pressure generating portion 46*i* may be positioned generally at a same level as the fuel level "P" in the vapor separator tank 45.

Figure 14:
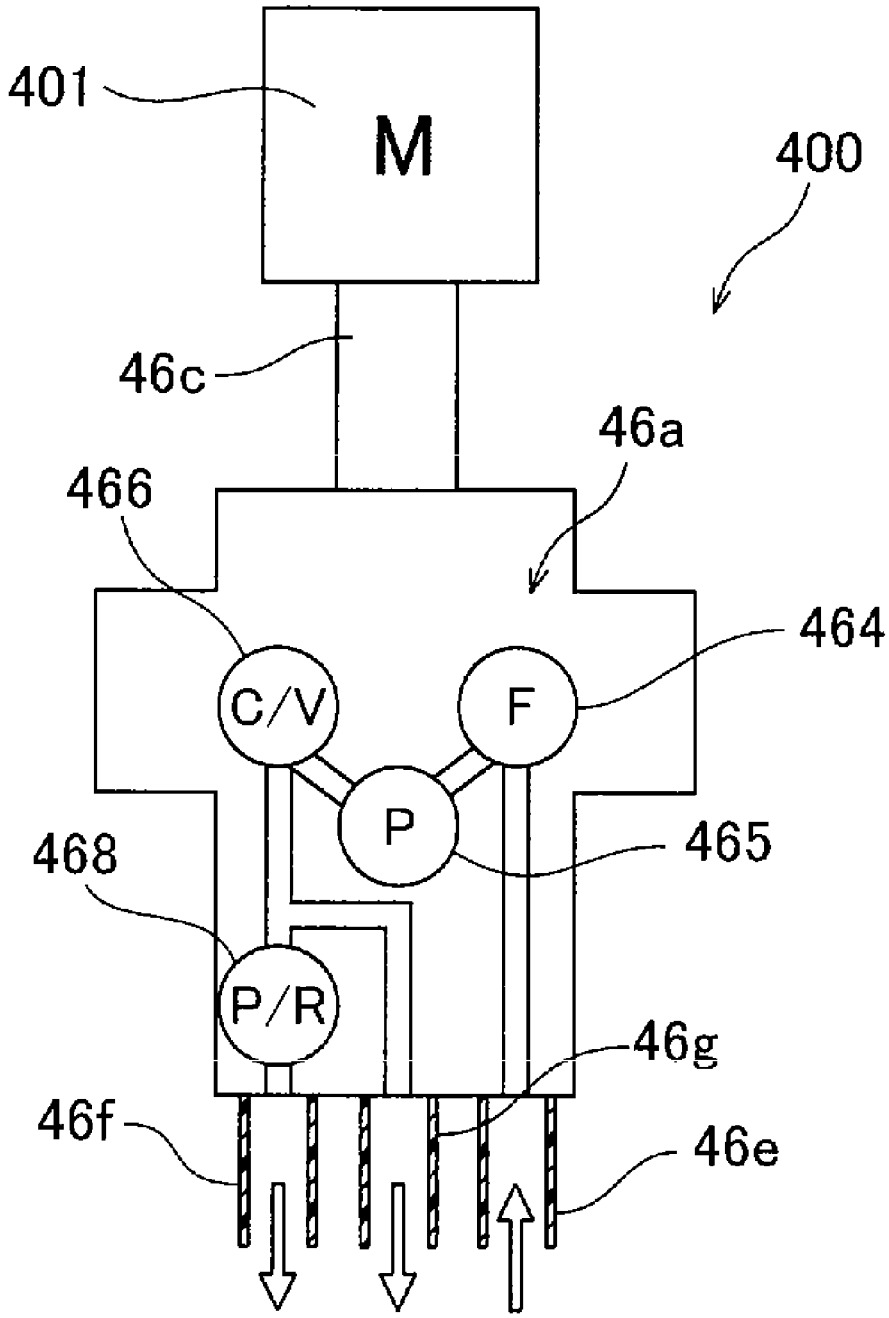
FIG. 14 is a schematic view showing a high-pressure fuel pump of an outboard motor according to a second variation of preferred embodiments of the present invention.

In the above preferred embodiment, the pulley 46*d* fixed to the rotary shaft 46*c* of the high-pressure fuel pump 46 preferably is meshed with the belt 26 for driving the camshaft 27 to drive the high-pressure fuel pump 46 using the driving force of the engine 20. However, the present invention is not limited to thereto. As in a high-pressure fuel pump 400 according to a second variation shown in FIG. 14, the high-pressure fuel pump 400 may be configured such that a motor 401 through which fuel does not pass drives to rotate a rotary shaft 46*c* and thereby drives a main pump portion 46*a* of the high-pressure fuel pump 400 through which fuel passes. Note that the motor 401 is an example of the "pump driving section" according to a preferred embodiment of the present invention.

In the above preferred embodiment, the rotary shaft 46*c* of the high-pressure fuel pump 46 preferably is rotated by the pulley 46*d* and the belt 26. However, the present invention is not limited thereto. The rotary shaft 46*c* maybe rotated by transmitting rotation of the camshaft 27 to the rotary shaft 46*c* of the high-pressure fuel pump 46 by using a gear and the like.

In the above preferred embodiment, gasoline is preferably used for fuel. However, the present invention is not limited thereto. Fuel may be alcohol, for example.

In the above preferred embodiment, the fuel supply system for a boat of the present invention is preferably applied to the outboard motor 1. However, the present invention is not limited thereto. The fuel supply system for a boat of the present invention may be applied to an inboard motor in which an engine section is mounted on a hull or to an inboard/outboard motor (stern drive).

Figure 15:
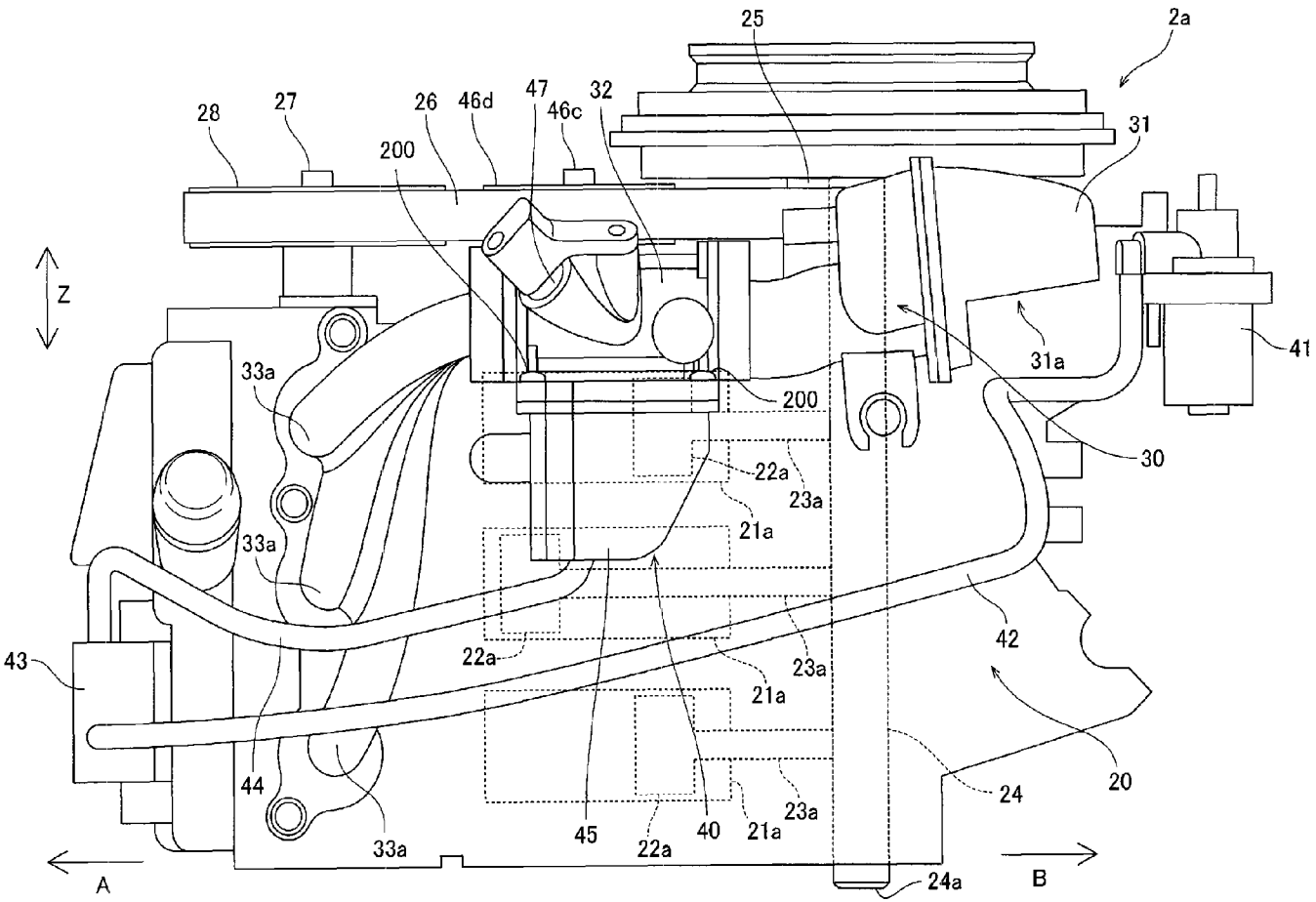
FIG. 15 is a side view of an engine section according to a third variation of preferred embodiments of the present invention.
Figure 16:
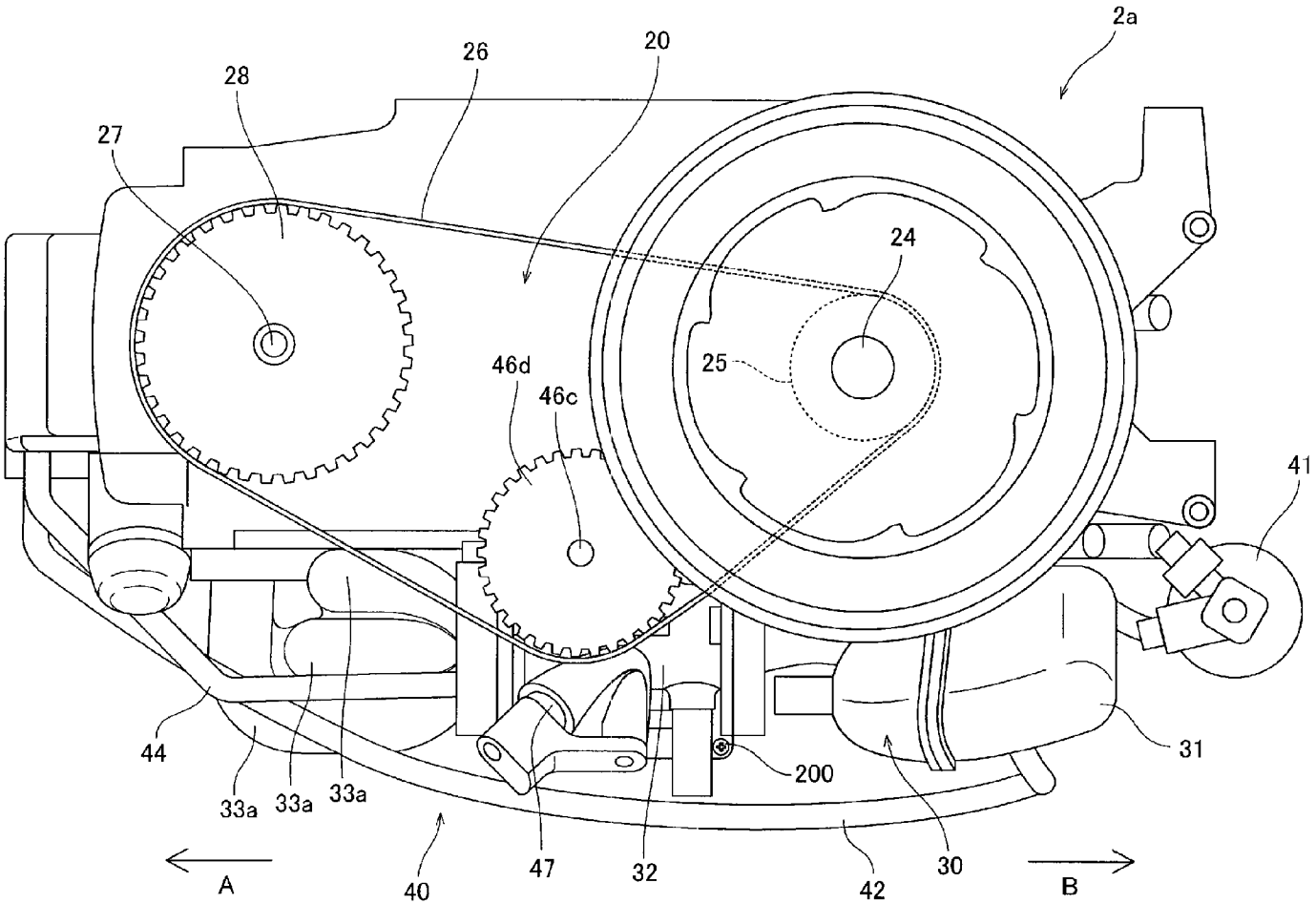
FIG. 16 is a plan view of the engine section according to the third variation of preferred embodiments of the present invention.

In the above preferred embodiment, the present invention is preferably applied to the outboard motor 1 that utilizes the two-cylinder engine section 2 with the two cylinders 21. However, the present invention is not limited thereto. The present invention may be applied to an outboard motor utilizes an engine section with one cylinder or more than two cylinders. For example, a three-cylinder engine section 2*a* according to a third variation shown in FIGS. 15 and 16 includes three cylinders 21*a* each having a piston 22*a* and a connecting rod 23*a*. The engine section 2*a* is connected to the throttle body 32 and includes three intake pipes 33*b* respectively connected to an intake port (not shown) of each of the three cylinders 21*a*. The construction other than the above is similar to that of the engine section 2 in the outboard motor 1.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A fuel supply system for a boat, the fuel supply system comprising:

a second fuel tank arranged to be connected to a first fuel tank mounted on a hull of a boat and arranged to maintain an inner fuel level at a predetermined height;

a fuel injection device arranged to supply fuel to an engine; and a fuel supply pump disposed outside the second fuel tank and arranged to supply the fuel in the second fuel tank to the fuel injection device; wherein the fuel supply pump includes a negative pressure generating portion inside the fuel supply pump and arranged to generate negative pressure when the fuel supply pump draws fuel, the negative pressure generating portion being positioned generally at a same level as or lower than the fuel level in the second fuel tank;

the fuel supply pump is adjacent to and fixed to a side of the second fuel tank; and a throttle body including a throttle valve arranged to adjust a flow rate of air supplied to the engine is adjacent to and fixed to at least one of the second fuel tank and the fuel supply pump.

2. The fuel supply system for a boat according to claim 1, further comprising a pipe arranged to connect the fuel supply pump and the second fuel tank, wherein the negative pressure generating portion of the fuel supply pump is positioned generally at a same level as or lower than a suction opening of the pipe in the second fuel tank.

3. The fuel supply system for a boat according to claim 1, wherein the fuel supply pump includes:

a fuel path;

a first check valve in the fuel path arranged to allow the fuel to pass therethrough from the second fuel tank to the fuel injection device;

a second check valve located closer to the fuel injection device relative to the first check valve in the fuel path and arranged to allow the fuel to pass therethrough from the second fuel tank to the fuel injection device;

a reserve section between the first check valve and the second check valve and arranged to hold fuel; and a negative pressure generating mechanism arranged to cause the negative pressure generating portion to generate negative pressure when the fuel supply pump draws fuel into the reserve section; wherein the negative pressure generating portion includes an area of the first check valve.

4. The fuel supply system for a boat according to claim 1, wherein the fuel supply pump is spaced apart from the engine.

5. The fuel supply system for a boat according to claim 1, wherein the fuel injection device is adjacent to the throttle body and arranged to inject fuel into the throttle body.

6. The fuel supply system for a boat according to claim 1, wherein the fuel supply pump further includes a pressure adjusting device arranged to release fuel when the pressure of the fuel supplied to the fuel injection device is at a same level as or larger than a predetermined value.

7. The fuel supply system for a boat according to claim 6, wherein the second fuel tank includes a vapor separator tank arranged to separate vaporized fuel from liquid fuel, and the pressure adjusting device is configured to return fuel to the vapor separator tank when the pressure of the fuel supplied to the fuel injection device is equal to or larger than the predetermined value.

8. The fuel supply system for a boat according to claim 1, wherein the fuel supply pump includes a pump main portion including the fuel path and a pump driving section spaced from the fuel path of the pump main portion.

9. The fuel supply system for a boat according to claim 8, wherein the pump driving section is configured to drive the pump main portion with a driving force of the engine.

10. The fuel supply system for a boat according to claim 8, wherein the pump driving section is configured to drive the pump main portion with a driving force of a motor spaced from the fuel path of the pump main portion.

11. An outboard motor comprising:

an engine;

a second fuel tank arranged to be connected to a first fuel tank mounted on a hull of a boat and arranged to maintain an inner fuel level at a predetermined height;

a fuel injection device arranged to supply fuel to the engine; and a fuel supply pump disposed outside the second fuel tank and arranged to supply the fuel in the second fuel tank to the fuel injection device; wherein the fuel supply pump includes a negative pressure generating portion inside the fuel supply pump and arranged to generate negative pressure when the fuel supply pump draws fuel, the negative pressure generating portion being positioned generally at a same level as or lower than the fuel level in the second fuel tank;

the fuel supply pump is adjacent to and fixed to a side of the second fuel tank; and a throttle body including a throttle valve arranged to adjust a flow rate of air supplied to the engine is adjacent to and fixed to at least one of the second fuel tank and the fuel supply pump.

12. The outboard motor according to claim 11, further comprising a pipe arranged to connect the fuel supply pump and the second fuel tank, wherein the negative pressure generating portion of the fuel supply pump is positioned generally at a same level as or lower than a suction opening of the pipe in the second fuel tank.

13. The outboard motor according to claim 11, wherein the fuel supply pump includes:

a fuel path;

a first check valve in the fuel path arranged to allow the fuel to pass therethrough from the second fuel tank to the fuel injection device;

a second check valve located closer to the fuel injection device relative to the first check valve in the fuel path and arranged to allow the fuel to pass therethrough from the second fuel tank to the fuel injection device;

a reserve section between the first check valve and the second check valve and arranged to hold fuel; and a negative pressure generating mechanism arranged to cause the negative pressure generating portion to generate negative pressure when the fuel supply pump draws fuel into the reserve section; wherein the negative pressure generating portion includes an area of the first check valve.

14. The outboard motor according to claim 11, wherein the fuel supply pump is spaced apart from the engine.

15. The outboard motor according to claim 11, wherein the fuel injection device is adjacent to the throttle body and arranged to inject fuel into the throttle body.

16. The outboard motor according to claim 11, wherein the fuel supply pump further includes a pressure adjusting device arranged to release fuel when the pressure of the fuel supplied to the fuel injection device is at a same level as or larger than a predetermined value.

17. The outboard motor according to claim 16, wherein the second fuel tank includes a vapor separator tank arranged to separate vaporized fuel from liquid fuel, and the pressure adjusting device is configured to return fuel to the vapor separator tank when the pressure of the fuel supplied to the fuel injection device is equal to or larger than the predetermined value.

18. The outboard motor according to claim 11, wherein the fuel supply pump includes a pump main portion including the fuel path and a pump driving section spaced from the fuel path of the pump main portion.

19. The outboard motor according to claim 18, wherein the pump driving section is configured to drive the pump main portion with a driving force of the engine.

20. The outboard motor according to claim 18, wherein the pump driving section is configured to drive the pump main portion with a driving force of a motor spaced from the fuel path of the pump main portion.

* * * * *